US005517894A

United States Patent [19]

Böhne et al.

[11] Patent Number: 5,517,894

[45] Date of Patent: May 21, 1996

[54] EXPLOSION PROOF MAT

[75] Inventors: Hans Böhne, Kuerten; Michael Mohr, Wuppertal, both of Germany

[73] Assignees: Clouth Gummiwerke AG, Koln; Akzo Faser AG, Wuppertal, both of Germany

[21] Appl. No.: 474,965

[22] Filed: Jun. 7, 1995

Related U.S. Application Data

[63] Continuation of Ser. No. 132,086, Oct. 5, 1993, abandoned.

[30] Foreign Application Priority Data

Oct. 12, 1992 [DE] Germany ..... 42 34 369.0

[51] Int. Cl.[6] ..... F41H 5/04; F41H 7/04

[52] U.S. Cl. ..... 89/36.02; 89/36.08; 296/39.1; 428/911

[58] Field of Search ..... 89/36.02, 36.08; 109/49.5, 80, 82, 83, 84; 296/39.1, 39.2, 39.3; 428/911

[56] References Cited

U.S. PATENT DOCUMENTS

| | | | |
|---|---|---|---|
| 1,324,234 | 12/1919 | Daigre | 109/82 |
| 3,577,836 | 5/1971 | Tamura | 428/911 |
| 4,391,178 | 7/1983 | Pagano | 89/36.08 |
| 4,664,967 | 5/1987 | Tasdemiroglu | 428/220 |
| 4,789,574 | 12/1988 | Selvey | 296/39.2 |
| 4,820,568 | 4/1989 | Harpell et al. | 428/113 |
| 4,836,084 | 6/1989 | Vogelesang et al. | 89/36.02 |
| 4,923,728 | 5/1990 | Snedeker | 428/911 |
| 5,124,195 | 6/1992 | Harpell et al. | 428/911 |
| 5,221,807 | 6/1993 | Vives | 89/36.02 |
| 5,316,820 | 5/1994 | Harpell et al. | 428/911 |
| 5,317,950 | 6/1994 | Binon et al. | 89/36.02 |

FOREIGN PATENT DOCUMENTS

| | | | |
|---|---|---|---|
| 1168195 | 12/1958 | France | 89/36.07 |
| 1578342 | 1/1970 | Germany . | |
| 2048205 | 4/1972 | Germany . | |
| 2151015 | 4/1973 | Germany . | |
| 2659727 | 7/1978 | Germany . | |
| 2927653A1 | 1/1981 | Germany . | |
| 2925109 | 5/1987 | Germany . | |
| 3627485 | 2/1988 | Germany | 89/36.08 |
| 671989A5 | 10/1989 | Germany . | |
| 3934558A1 | 4/1991 | Germany . | |
| WO91/07275 | 5/1991 | WIPO . | |

*Primary Examiner*—Stephen C. Bentley
*Attorney, Agent, or Firm*—Cohen, Pontani, Lieberman, Pavane; Christa Hildebrand

[57] ABSTRACT

The invention relates to an explosion-proof mat for protecting structures that enclose occupant accommodations in vehicles. The mat has several layers of textile impact-resistant sheet saturated with impregnating material and conforming to the shape of the accommodation-enclosing structure. The impregnating material is flexible after curing. A rigid sheet of composite is embedded between two inner layers of the textile sheets.

11 Claims, 1 Drawing Sheet

EXPLOSION PROOF MAT

This is a continuation of application Ser. No. 08/132,086, filed Oct. 5, 1993, now abandoned.

BACKGROUND OF THE INVENTION

The present invention concerns an explosion-proof mat. Such mats are especially employed to protect the structures that enclose occupant accommodations in vehicles. They comprise several layers of textile impact-resistant sheet saturated with impregnating material and conforming to the shape of the accommodation-enclosing structure. The invention also concerns a method of manufacturing such mats.

Mats and covering of this type are known from the cladding of armored-vehicle floors. They are manufactured with woven impact-resistant sheet material, sheets of aramid of the types known from the manufacture of bullet-proof vests for example. The known covering comprises approximately six layers of woven aramid laid against the floor of the vehicle and saturated with impregnating material to produce a molding that includes the layers and prevents them from absorbing moisture. This procedure requires considerable manual labor. It is also time-consuming because the impregnating material can take several days to cure completely, during which no other operations are possible inside the vehicle. Although the woven aramid does render covering of this type sufficiently resistant to the force of artillery, mines, bombs, and grenades, it is not rigid enough to resist the compressive forces that accompany explosions. A standard armored-vehicle test explosion can buckle a floor protected with the known covering more than 30 cm. This result represents a considerable hazard for the occupants.

Covering that is rigid enough to resist the force of an explosion is known. It comprises compression-molded composites of glass-fiber reinforced plastic approximately 12 mm thick. However, this product has drawbacks. One drawback is that it weighs approximately 24 kg/m$^2$. Another is that a mold that conforms to the shape of the floor is needed for each model of vehicle, which adds to the expense.

SUMMARY OF THE INVENTION

The object of the present invention is accordingly explosion proofing in the form of a mat that is light in weight and inexpensive to manufacture while providing adequate defense against not only artillery, mines, bombs, and grenades but against the compressive forces that accompany explosions.

This object is attained in accordance with the invention in that the impregnating material, rubber in particular, is flexible after curing and in that a rigid sheet of composite that parallels the major plane of the structure that encloses the occupant accommodation is positioned between two inner layers of the woven sheet.

Because the sheets are saturated with an impregnating material, especially a material that can be vulcanized, that is flexible after curing, the finished mat can be removed from the mold and installed in the form of a molding in the vehicle's occupant accommodation. The rigid sheet of composite that parallels the major plane of the accommodation-enclosing structure and is positioned between two inner layers of the woven sheet provides the mat with enough strength to resist the compressive forces that accompany the explosion.

It is preferable for the rigid sheet of composite to have a honeycomb core of plastic or aluminum with a skin over each outer demarcation. The sheet of composite can alternatively have a corrugated plastic or aluminum core, an embodiment that is, however, rigid in only one direction. A sheet 5 to 20 mm thick will adequately resist the compressive forces. A standard explosion will deform a floor protected with such a sheet less than 10 cm, which is approximately ⅓ the deformation that occurs in conjunction with a sheet of woven aramid saturated with plastic. The mat in accordance with the invention will weigh less than 6 kg/m$^2$, which is much lighter than the conventional glass-fiber reinforced versions.

The textile sheet that constitutes part of the mat in accordance with the invention preferably consists of aramid. Hopsack-weave aramids with webs and woofs of equal strength have been proven particularly effective. Since the aramid sheet owes some of its impact resistance to resilience, it is preferable to position most of the woven layers between the sheet of composite and the occupant accommodation. Layers between the structure that encloses the occupant accommodation and the sheet of composite are not resilient enough to significantly impede shells and fragments.

To prevent the transmission of vibrations between the sheet of composite and the layers of textile sheet that conform to the shape of the structure that encloses the occupant accommodation, the gaps in that vicinity can be occupied by expanded plastic.

Another object of the present invention is a simple and cost-effective method of manufacturing explosion-proof mats in accordance with that invention.

The layers of textile impact-resistant sheet and sheets of composite can be automatically introduced into the mold. Curing time is integrated into the time needed to manufacture the mat and will not delay work on the vehicle's armor. The result is a molding that can be rapidly applied and secured to its site in the occupant accommodation.

The impregnating material in one preferred embodiment of the method is rubber and is vulcanized, once the rubberized textile sheet and the sheet of composite have been introduced into the mold, in an autoclave at a pressure of approximately 7 bars and a temperature of approximately 150° C.

The sheet-metal structure that encloses the occupant accommodation can be exploited as the mold, eliminating the need for an expensive specially made mold.

BRIEF DESCRIPTION OF THE DRAWINGS

The invention will now be specified with reference to the drawing, wherein.

DESCRIPTION OF THE PREFERRED EMBODIMENTS

Figure 1:
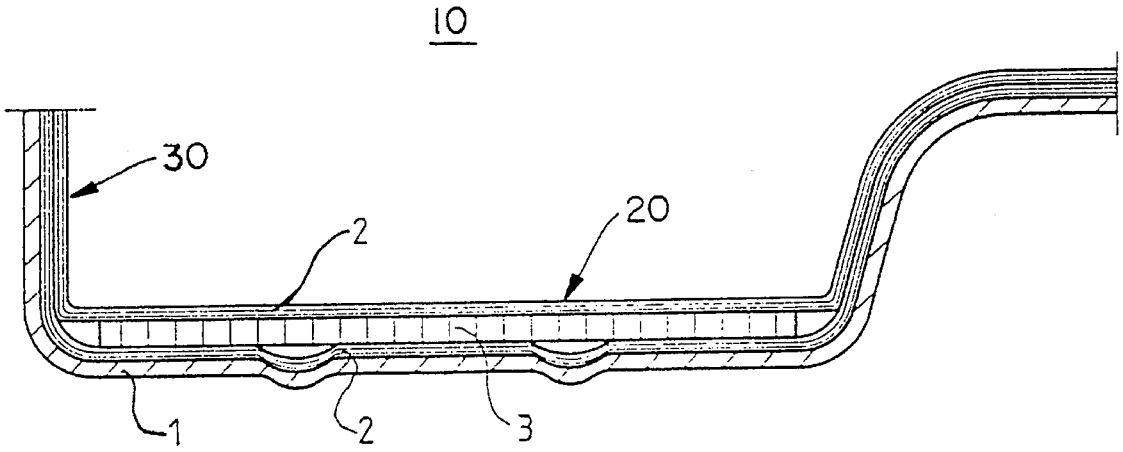
FIG. 1 is a longitudinal section through a preferred embodiment of an explosion-proof mat accommodated in the occupant accommodation of a vehicle and FIG. 2 is a longitudinal section through an explosion-proof mat accommodated in a occupant accommodation and with its gaps occupied by expanded plastic.

FIG. 1 shows the overall assembly of mat 10 as utilized in a car compartment. The layers 2 of textile impact-resistant sheet illustrated in FIG. 1 are positioned against the structure 1, in this case a sheet-metal floor, that encloses the occupant accommodation of a vehicle. Positioned between the layers is a sheet 3 of composite comprising a honeycomb core with a skin over each outer demarcation. Sheet of composite 3 is applied only to those areas of accommodation-enclosing structure 1 covered by occupant seats. Rigidity on the part of the mat is less necessary at the sides of the vehicle, on the fight of the transmission tunnel for example and on the left of the area reinforced by the thresholds. In FIG. 1, the rigid sheet 3 forms the rigid area 20 and a flaccid area 30 is formed by the flaccid portion of the mat beyond the confines of the composite sheet.

Figure 2:
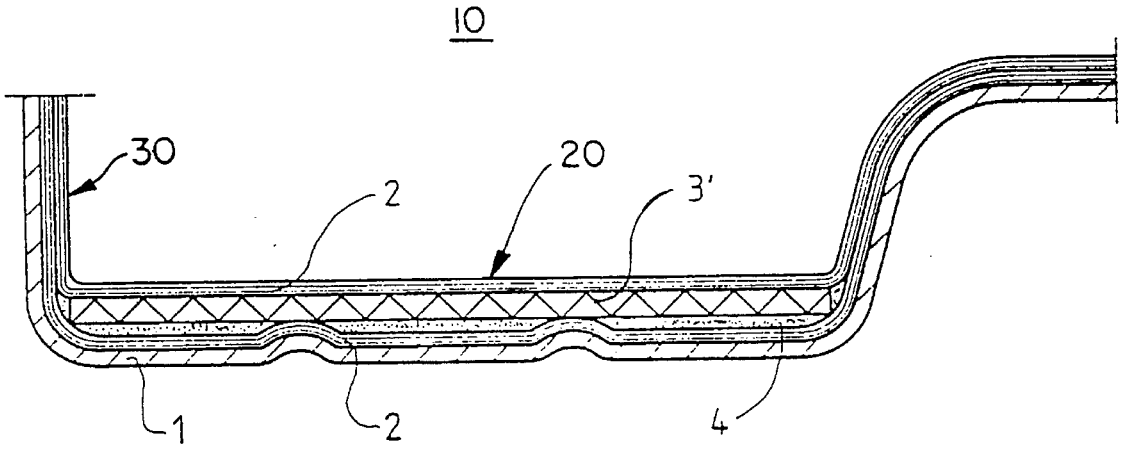

The rigid intermediate layer constituted by the sheet 3' of composite illustrated in FIG. 2 is corrugated or peaked aluminum or plastic sheet with a skin over each outer demarcation. Since the sheet of composite rests against only those areas of the layers 2 of textile impact-resistant sheet that conform to the shape of the ribs in accommodation-enclosing structure 1, the gaps are occupied by expanded plastic 4 to attenuate any vibrations.

The embodiments illustrated in FIGS. 1 and 2 can also be produced in molds that can be inserted in an autoclave to vulcanize the rubber components. The mold can be an accommodation-enclosing structure 1 itself as made available by the manufacturer.

We claim:

1. A light-weight explosion-proof mat for protecting a section of a structure enclosing an occupant-accommodation area of a vehicle including a base and first and second side walls, said mat being defined by first and second end sections and a midsection positioned therebetween, comprising:

first and second impact-resistant textile sheets positioned in a layered relationship with each other, each of said first and second sheets being saturated with impregnating material remaining flexible after curing; and a rigid sheet of composite positioned between said first and second layers at about the midsection of said mat and extending across and parallel to the section to be protected;

said midsection covering the base and having a rigidity greater than said first and second end sections, and said first and second end sections extending on either side of said rigid sheet and along the first and second side walls respectively of the structure enclosing the occupant-accommodation area.

2. The light-weight explosion-proof mat of claim 1, wherein the rigid sheet of composite comprises a honeycomb core having a skin over each outer demarcation.

3. The light-weight explosion-proof mat of claim 2, wherein the specific weight of the rigid sheet of composite is less than 6 $kg/m^2$.

4. The light-weight explosion proof mat of claim 1, wherein the rigid sheet of composite comprises a corrugated core material having a skin over each outer demarcation.

5. The light-weight explosion-proof mat of claim 4, wherein the specific weight of the rigid sheet of composite is less than 6 $kg/m^2$.

6. The light-weight explosion-proof mat of claim 1, wherein the specific weight of the rigid sheet of composite is less than 6 $kg/m^2$.

7. The light-weight explosion-proof mat of claim 6, wherein the first and second sheets are composed of aramide.

8. The light-weight explosion-proof mat of claim 7, wherein the corrugated core material is aluminum.

9. The light-weight explosion-proof mat of claim 7, wherein the corrugated core material is plastic.

10. The light-weight explosion-proof mat of claim 1, further comprising a layer of expanded plastic disposed between the rigid sheet of composite and at least one of the first and second sheets for absorbing vibrations.

11. The light-weight explosion-proof mat of claim 1, wherein said first and second textile sheets each include a plurality of layers.

* * * * *